US006843012B1

(12) United States Patent
Dodd

(10) Patent No.: US 6,843,012 B1
(45) Date of Patent: Jan. 18, 2005

(54) BACKPACK DISPLAY UNIT

(75) Inventor: Mark C. Dodd, Pendleton, IN (US)

(73) Assignee: Dodd Technologies, Inc., Pendleton, IN (US)

( * ) Notice: Subject to any disclaimer, the term of this patent is extended or adjusted under 35 U.S.C. 154(b) by 0 days.

(21) Appl. No.: 10/652,682

(22) Filed: Aug. 29, 2003

(51) Int. Cl.[7] ..... G09F 21/02

(52) U.S. Cl. ..... 40/586; 224/627; 224/930; 353/79

(58) Field of Search ..... 40/586; 224/275, 224/627, 634, 645, 655, 930; 348/837, 838; 340/573.1; 353/79

(56) References Cited

U.S. PATENT DOCUMENTS 4,037,763 A * 7/1977 Turchen ..... 224/634
4,462,525 A * 7/1984 Pingleton et al. ..... 224/634
5,892,445 A * 4/1999 Tomich ..... 40/586
5,912,653 A * 6/1999 Fitch ..... 40/586
6,092,705 A * 7/2000 Meritt ..... 224/275
6,097,448 A * 8/2000 Perkins ..... 348/837
6,216,927 B1 * 4/2001 Meritt ..... 224/275
6,334,687 B1 * 1/2002 Chino et al. ..... 353/79
6,393,745 B1 * 5/2002 Miki ..... 40/586

* cited by examiner

*Primary Examiner*—Lars A. Olson
(74) *Attorney, Agent, or Firm*—Woodard, Emhardt, Moriarty, McNett & Henry LLP

(57) ABSTRACT

The portable display unit carried by a person for displaying a message at an elevation above the person. A media player, inverter, and screen power supply are mounted within a backpack having a video screen mounted above and to the backpack. The backpack includes a hip-circling belt carrying a power supply.

19 Claims, 5 Drawing Sheets

BACKPACK DISPLAY UNIT

BACKGROUND OF THE INVENTION

The present invention relates generally to the field of electrically operated displays or billboards.

DESCRIPTION OF THE PRIOR ART

A variety of billboards have been provided that may be worn or held by a person either walking or standing. Typically, a pair of display boards are worn on the back and front of the person with the boards providing an advertisement or message. Such boards are commonly referred to as sandwich boards. These billboards are so common that they tend to be ignored. Likewise, depending upon the height of the person wearing the boards, the advertisement or message cannot be seen by others. In addition, the advertisement or message is fixed on the billboards requiring delay and cost associated in the event the advertisement or message is to be changed.

A variety of messaging devices are available with the advent of electronic screens such as the LCD (liquid crystal diode) screen. Such screens are used in a variety of locations, for example for scoreboards in various ballparks or arenas. The screens allow the advertisement or message to move relative to the screen and change depending upon the input signal fed to the screen.

I have combined the technology of the aforementioned video screens with the prior billboards to provide a variable display screen to display a variable advertisement or message. In addition, I have elevated the screen above the person wearing the assembly so that the advertisement or message may be seen by others from a great distance regardless of the height of the person wearing the assembly.

SUMMARY OF THE INVENTION

A portable display unit comprising a main frame having a harness to removably mount on a person. A display is secured to the main frame to display a message. A power supply and a media player are mounted on the frame and are connected to the display. An extender is mounted to and between the main frame and the display. The extender extends upwardly from the main frame to the display elevating the display above the main frame and the person.

It is an object of the present invention to provide an electronic billboard mounted to and above a person.

It is a further object of the present invention to provide a new and improved billboard to be carried by a person.

A further object of the present invention is to provide an electronic billboard mounted to a human carrier with the billboard displaying a changeable message.

Related objects and advantages of the present invention will be apparent from the following description.

DESCRIPTION OF THE PREFERRED EMBODIMENT

Figure 1:
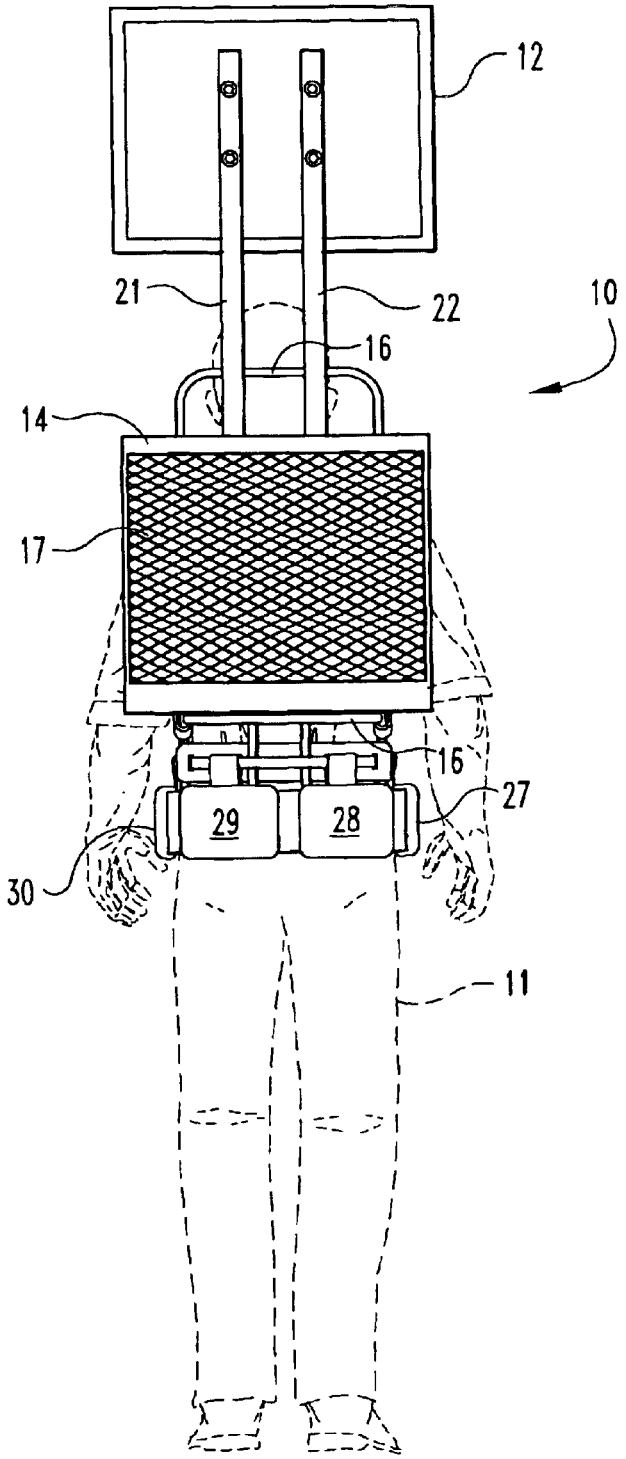
FIG. 1 is a rear view of the portable display unit incorporating the present invention shown positioned on a person.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
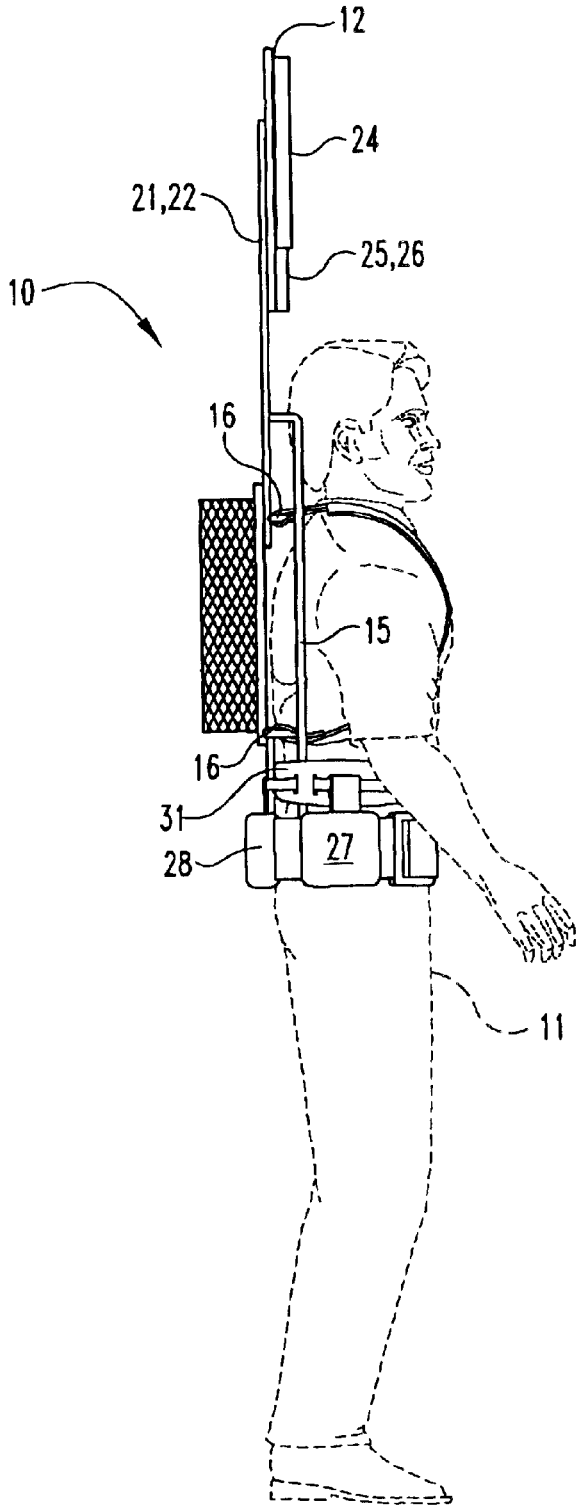
FIG. 2 is side view.
Figure 3:
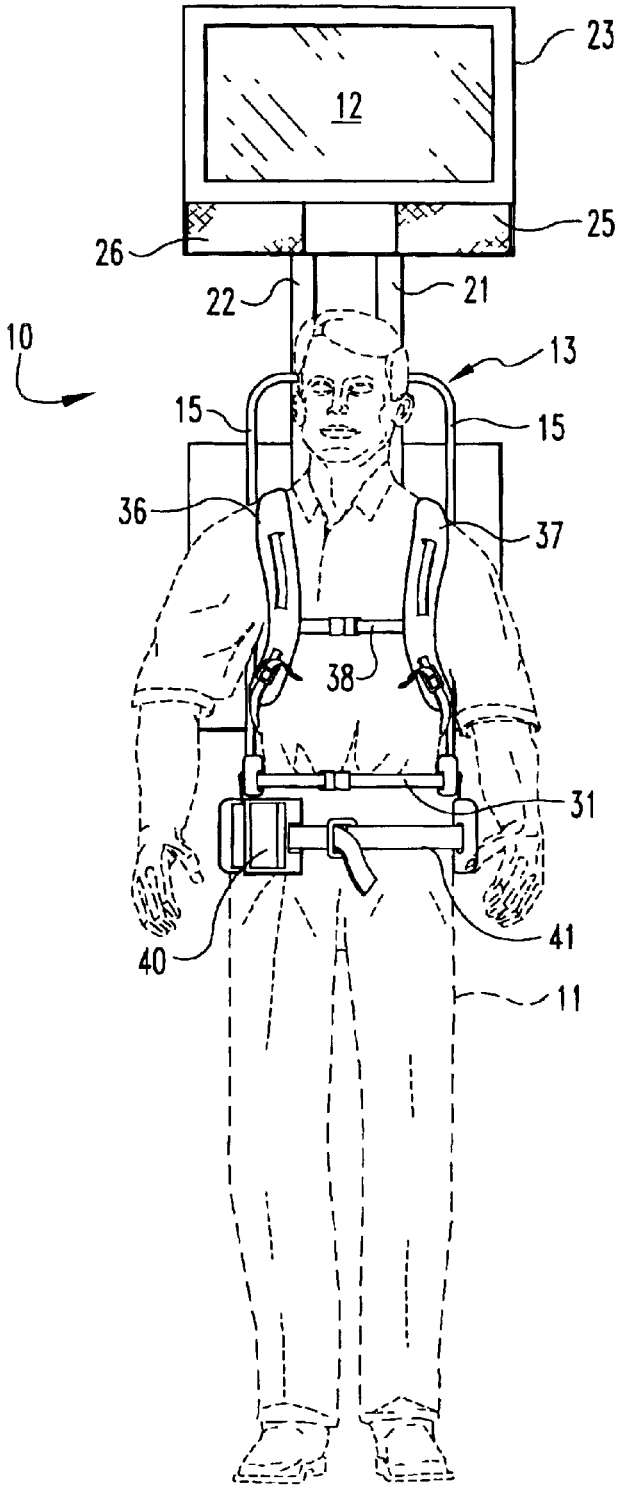
FIG. 3 is a front view.

Referring now more particularly to FIGS. 1–3, the portable display unit 10 is shown mounted to a person 11 by means of a backpack configuration with the display screen 12 located above the person thereby providing a clearly visible advertisement or message obtained from the media player within the backpack. The backpack may take a variety of configurations. In the drawings, the backpack is shown as having an external frame 13 upon which is mounted a rigid plate 14. Frame 13 may consist of the known construction of external frame backpacks in that a plurality of tubes 15 are fixedly secured together by cross members 16. Plate 14 is mounted to tubes 15. Tubes 15 extend vertically up the person's back and rest thereagainst keeping plate 14 spaced from the person thereby enabling air to circulate between the person and the plate. Thus, tubes 15 are positioned between plate 14 and the person's back. A mesh screen of fabric or metal or other suitable material is securable to mounting plate 14 enclosing the various components mounted to the plate. Screen 17 is removable to allow access to the components and is designed to allow air to pass therethrough to facilitate cooling of the components. Screen 17 is secured to plate 14 by conventional fastening devices.

Figure 4:
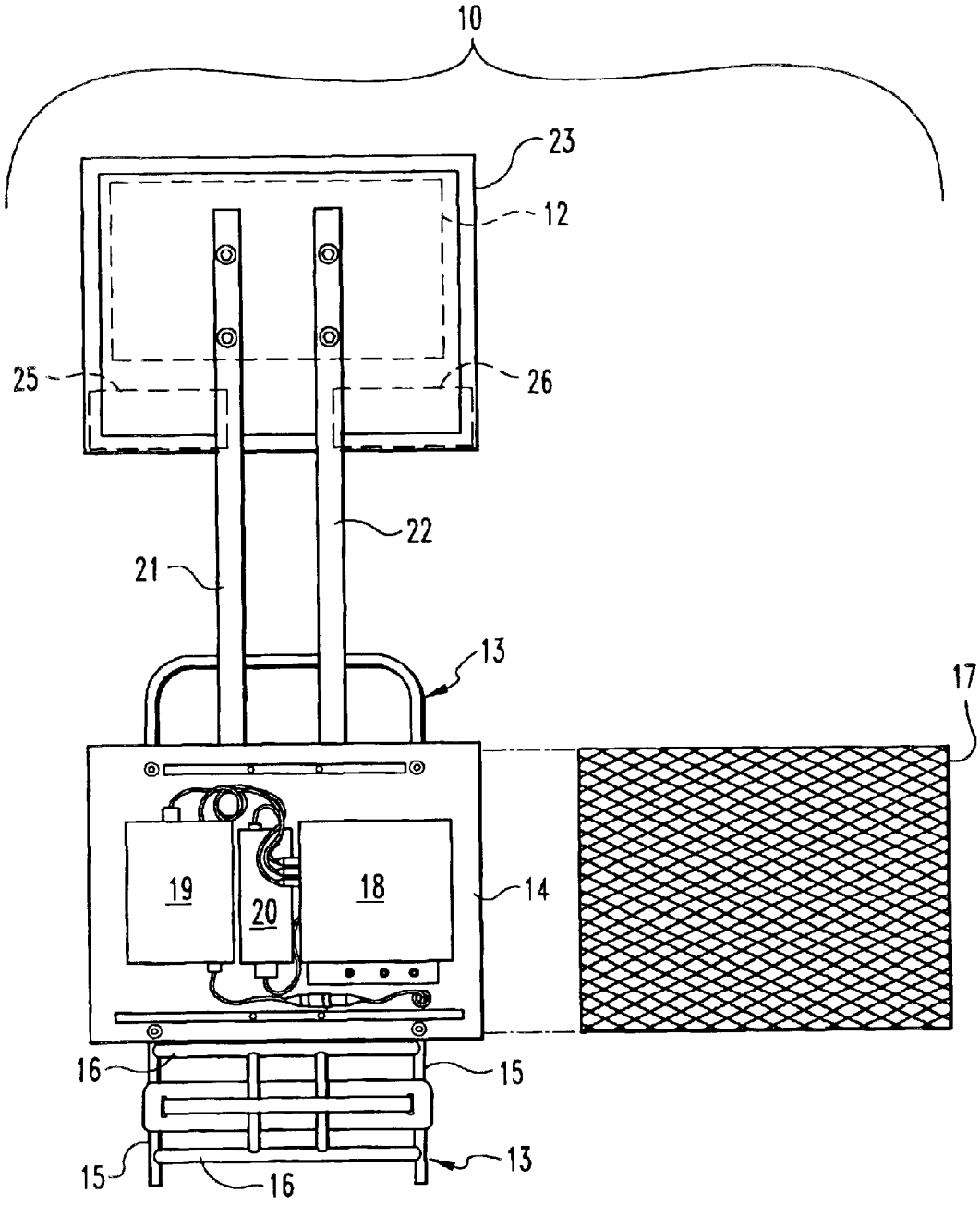
FIG. 4 is an enlarged view of the portable display unit with the outer cover removed.

A media player 18 (FIG. 4) is fixedly mounted to plate 14 and takes the form of a tape playback device or a DVD. A variety of commercially available media players are available such as the media player, Model AVD300 available from Audiovox Corporation, 555 Wireless Blvd., Hauppauge, N.Y. 11788. The media player 18 is mounted to the plate to allow insertion and removal of tapes and/or discs. A direct current to alternating current power inverter 19 is mounted to plate 14. Such inverters are commercially available such as produced by Xantres Technology Company under Model Name Portawattz 300 located in Vancouver, British Columbia. A display screen power supply 20 is also mounted to plate 14 and typically is provided with the display screen mounted at an elevation above the backpack.

In the embodiment shown in the drawings, a pair of rigid extensions or members 21 and 22 have bottom ends fixedly secured to plate 14 and top ends fixedly secured to the video display unit 23. Extensions 21 and 22 are hollow allowing electrical wiring to extend from the components on mounting plate 14 to the video display unit 23. In the preferred embodiment, video display unit 23 includes a LCD (liquid crystal diode) display screen 12 with a pair of audio speakers 25 and 26 mounted to the unit and providing the left and right component of the audio. A variety of display screens may be utilized; however, best results have been obtained by using an 18-inch LCD display screen manufactured by Sony under Model No.V72W1B that is provided with an external power supply 20.

The main power source consists of a plurality of batteries located within battery enclosures 27–30 (FIGS. 1 and 2)

contained within fabric enclosures, in turn, mounted to the bottom ends of frame 13.

External backpacks include a hip-encircling belt or strap 31 fastened to the bottom ends of the backpack main frame and positioned against the hips of the person wearing the backpack. Typically, tubes 15 are telescopically constructed to allow for the positioning of strap 31 against the hips thereby transferring the load from the backpack from the shoulders to the hips. In similar fashion, the portable display unit 10 includes a strap 31 attached to the bottom ends of the frame with opposite ends connectable together in the conventional fashion to allow the strap to encircle the hips and then fasten together.

Fabric enclosures 27–30 are suspendedly secured to strap 31 and are hollow to receive the plurality of batteries. A lower strap 41 extends through or is attached to enclosures 27–30 with the opposite ends of strap 41 being fastenable together in front of the person securing the enclosures. The battery enclosures may be utilized from materials in addition to fabric so long as the enclosures are lightweight in nature. The battery enclosures and batteries may be provided by the commercially available power belts carried by cameramen.

Figure 5:
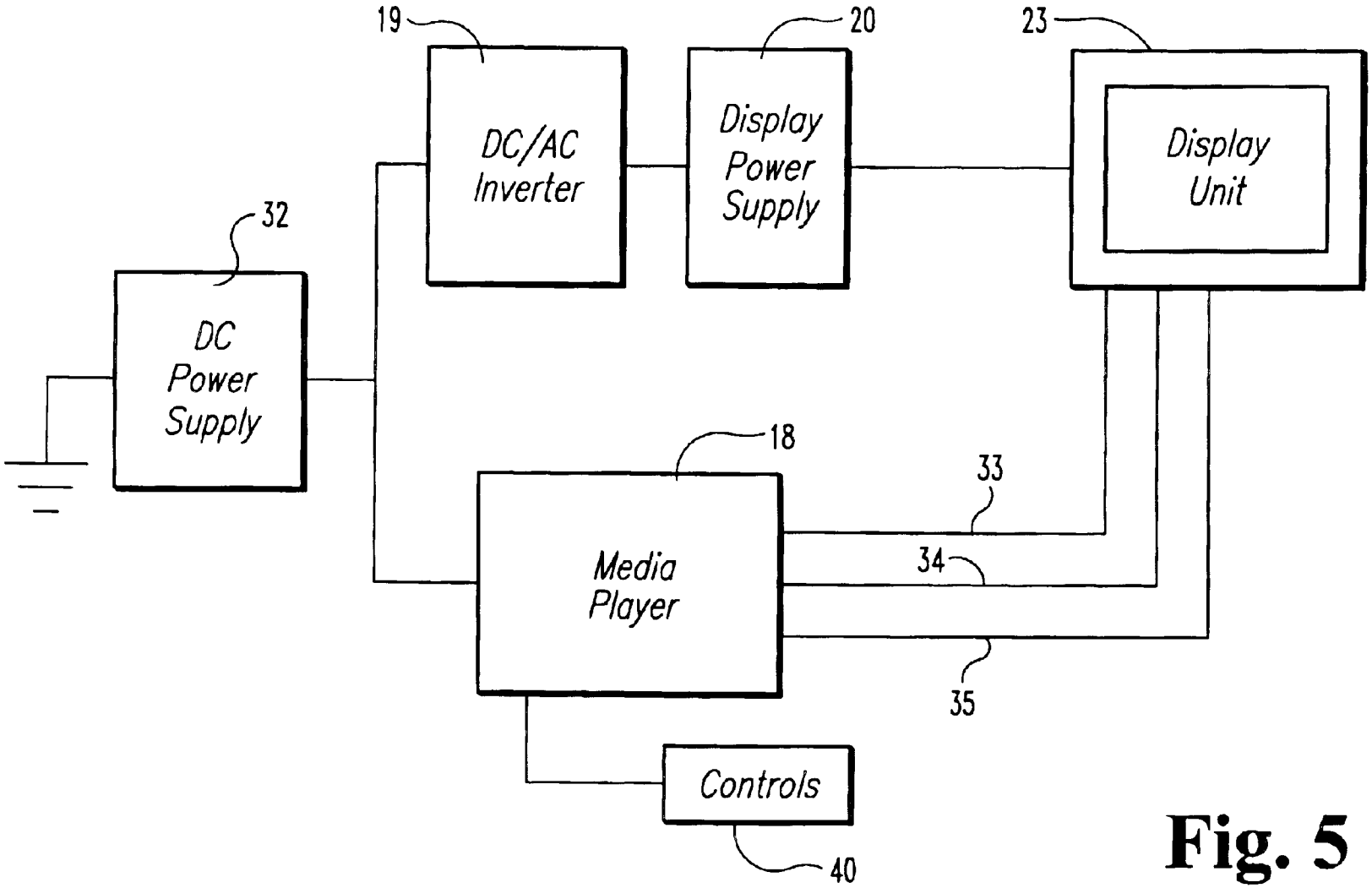
FIG. 5 is a schematic representation of the portable display unit.

Referring to the schematic representation in FIG. 5, the DC power supply 32 represents the plurality of batteries worn around the hips of the person wearing the backpack. The DC power supply is connected directly to the media player 18 and to the DC/AC inverter 19. Inverter 19 converts the 12-volt direct current of power supply 32 into an alternating current furnished to the display power supply 20 provided with the display unit 23. Media player 18 provides a left component and right component of an audio signal that are provided by wiring 33 and 34 connected to display unit 23. The media player has a video output signal provided via wiring 35 connected to the display unit 23.

The backpack consisting of the main frame 13, mounting plate 14, and screen 17 is securable to the back of a person with a conventional harness that extends over the shoulders of the person and then downwardly in a conventional fashion. Thus, a first shoulder strap 36 (FIG. 3) has a top end mounted to the frame 13 with the strap then extending over the shoulder and down across the chest of the person having a bottom end fastened to frame 13. Likewise, a second strap 37 has a top end connected to frame 13 with the strap then extending over the shoulder opposite from the shoulder upon which strap 36 extends. Strap 37 then extends downwardly across the chest and has a bottom end fastened to the main frame. A horizontally extending strap 38 has opposite ends secured to straps 36 and 37 with strap 38 having a connector between the opposite ends of strap 38 to allow the strap to be coupled facilitating the removal and mounting of the backpack to the person. Strap 38 keeps straps 36 and 37 in their proper position.

My portable display unit is particularly unique in that the video display screen is located at an elevation above the backpack main frame and other components and locates the video screen at an elevation above the carrier's head thereby allowing others to see the message displayed thereon in the event the display unit is mounted on a relatively short person who is working through a crowd. Extensions 21 and 22 are rigid and are mounted to the rigid mounting plate with the display screen extending generally vertical when the person wearing the backpack is in an erect walking position. The backpack is carried on the back of the person and is therefore located behind the person. Normally, the video screen faces forwardly; however, the present invention contemplates having a video screen faced rearward or having a plurality of video screens mounted to the extensions with one screen facing forward and the opposite screen facing rearward.

A control panel 40 (FIG. 5) may be connected to the media player by suitable wiring and may be carried in a pocket attached to strap 41. Alternatively, control 40 may be a conventional wireless transmitter operable to control the media player. As such, the control 40 provides for remote control of the media player. As such, the media player may be turned on or off or may be controlled to select a particular message prerecorded on tape or DVD.

Many variations are contemplated and included in the present invention in addition to those previously described. For example, the media player may utilize a floppy disc and compact disc in addition to the videotapes and DVD's previously discussed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A portable display unit mountable on a person comprising:

a main frame having a harness to removably mount on a person;

a display secured to said main frame to display a message;

a power supply;

a media player mounted on said frame and connected to said power supply and said display to display a message on said display; and, an extender mounted to and between said main frame and said display, said extender extending upwardly from said main frame to said display elevating said display above said main frame and the person having the portable display unit mounted thereon.

2. The display unit of claim 1 wherein:

said power unit includes a battery.

3. The display unit of claim 2 wherein:

said media player is a tape recorder.

4. The display unit of claim 2 wherein:

said media player is a DVD player.

5. The display unit of claim 2 wherein:

said main frame and said harness form a backpack that holds said power supply and said media player.

6. The display unit of claim 5 wherein:

said extender includes a pair of members extending upwardly and connecting said display located above the person and said backpack with said backpack locatable behind the person.

7. The display unit of claim 6 wherein:

said frame includes a bottom end and a hip encircleable binding at said bottom end, said power supply is secured to said binding.

8. The display unit of claim 7 wherein:

said frame includes a mounting plate with said harness fastened thereto along with said media player; and further comprising:

a direct current to alternating current inverter mounted to said mounting plate and connected between said power supply and said display.

9. The display unit of claim 8 wherein:

said media player includes a video output signal and an audio output signal to feed to said display.

10. A video display mountable upon a person to provide a video message at an elevation above the person wearing the display comprising:

an assembly securable to a person;

a media player secured to said assembly and having a video output signal;

a video display unit operatively associated with said media player and having a video screen to receive said video output signal and display a message on said video screen; and, an extender positioned between and connected to said assembly and said video display unit positioning said video display unit at a higher elevation relative to said assembly and said person.

11. The video display assembly of claim 10 and further comprising:

a power supply connected to said media player; and wherein:

said video display unit includes an audio output signal.

12. The video display assembly of claim 11 wherein:

said video screen is a liquid crystal diode screen.

13. The video display assembly of claim 10 wherein:

said assembly includes a harness and a mounting plate, said extender includes a rigid member connected to and between said mounting plate and said video display unit.

14. The video display assembly of claim 10 and further comprising:

a power supply connected to said media player with said power supply having a direct current output; and, a processing assembly connected to and between said power supply and said video display unit to change said direct current output for powering said video display unit.

15. A video display assembly mountable upon a person to provide a video message for others to see comprising:

a support wearable by a person;

a media unit mounted to said support and having an output video signal; and, a video display screen wearable by the person wearing said support and located above the media unit, support and person when worn, said video display screen to receive said output video signal and display a video message corresponding to said output video signal thereon.

16. The video display assembly of claim 15 and further comprising:

a power unit wearable by the person wearing said support and connected to said media unit.

17. The video display assembly of claim 16 and further comprising:

an extension wearable by the person wearing said support and being connected to said video display screen elevating said video display screen above the support and person wearing it.

18. The video display assembly of claim 17 wherein:

said power unit includes a battery with a direct current output and further comprising:

a direct current processing unit to process said direct current output to power said media unit and said video display screen.

19. The video display assembly of claim 18 wherein:

said support includes a rigid mounting plate with said extension connected to and between said plate and said video display screen.

* * * * *